US006056510A

United States Patent [19]

Miura et al.

[11] Patent Number: 6,056,510

[45] Date of Patent: May 2, 2000

[54] MULTISTAGE VACUUM PUMP UNIT

[75] Inventors: Atsuyuki Miura; Hiroya Taniguchi, both of Aichi-ken, Japan

[73] Assignee: Aisin Seiki Kabushiki Kaisha, Kariya, Japan

[21] Appl. No.: 08/980,848

[22] Filed: Dec. 1, 1997

[30] Foreign Application Priority Data

Nov. 30, 1996 [JP] Japan ..... 8-334924

[51] Int. Cl.[7] ..... F04B 41/06

[52] U.S. Cl. ..... 417/2; 417/19; 417/44.1; 417/32; 417/243; 417/286

[58] Field of Search ..... 417/2, 19, 44.1, 417/32, 243, 286

[56] References Cited

U.S. PATENT DOCUMENTS

| | | | |
|---|---|---|---|
| 3,584,977 | 6/1971 | Coleman, II et al. | 417/53 |
| 4,279,574 | 7/1981 | Kunderman | 417/243 |
| 5,158,436 | 10/1992 | Jensen et al. | 417/32 |
| 5,496,393 | 3/1996 | Otsuka et al. | 95/19 |
| 5,584,914 | 12/1996 | Senoo et al. | 96/6 |
| 5,746,581 | 5/1998 | Okumura et al. | 417/2 |
| 5,971,711 | 10/1999 | Noji et al. | 417/2 |

FOREIGN PATENT DOCUMENTS 308-846 3/1989 France .

*Primary Examiner*—Timothy S. Thorpe
*Assistant Examiner*—Ehud Gartenberg
*Attorney, Agent, or Firm*—Oblon, Spivak, McClelland, Maier & Neustadt, P.C.

[57] ABSTRACT

A multistage vacuum pump unit having a plurality of separate single-stage pumps connected in series with each other by exhaust pipes, the exhaust pipes each connecting a suction port of one of the adjacent single-stage pumps with an exhaust port of another of the adjacent single-stage pump; motors for driving the separate single-stage pumps respectively; driving device for varying a revolution of one of the single-stage pumps that is at least in contact with an atmospheric side; driving current detection device for detecting a driving current of the motor for driving the single-stage pump that is in contact with the atmospheric side; pressure detection device for detecting a pressure at a vacuum-side inlet; and control device for controlling revolutions of the motors of the single-stage pumps based on the pressure detected by the pressure detection device.

18 Claims, 8 Drawing Sheets

VACUUM LEVEL & POWER

MULTISTAGE VACUUM PUMP UNIT

BACKGROUND OF THE INVENTION

1. Field of the Invention

The present invention relates to a multistage vacuum pump unit including a plurality of separate single-stage pumps connected in series with each other by exhaust pipes each connecting a suction port of a single-stage pump with an exhaust port of another of the adjacent single-stage pumps subsequent to the single-stage pump, motors for driving the separate single-stage pumps respectively, driving means for varying a revolution of the pump that is at least in contact with an atmospheric side, and driving current detection means for detecting a driving current of the motor for driving the pump that is in contact with the atmospheric side. The multistage vacuum pump unit thus constructed improves a backing pressure-side vacuum level at an exhaust port of the vacuum-side single-stage pump that is connected in series with the subsequent single-stage pump, prevents a pumping speed from decreasing, and inhibits a driving force (power) from increasing.

2. Description of the Prior Art

FIG. 9 illustrates a first conventional multistage vacuum pump unit disclosed in Japanese Patent Application Laid-Open No. Hei 5-240181. This pump unit is provided with two separate pumps P1, P2 driven by separate motors M1, M2 respectively. The motors M1, M2 are activated via an ac power that is supplied from inverters I1, I2. The inverters I1, I2 are controlled by a controller CR.

FIG. 10 illustrates a second conventional multistage vacuum pump unit disclosed in Japanese Patent Application Laid-Open No. Hei 7-305689. This pump unit is provided with a plurality of Roots pumps R1 to R4 accommodated in separate casings C respectively. Pump chambers PC are connected in series with each other by exhaust pipes E2 to E4. Drive shafts of rotors RT allocated to the respective Roots pumps R1 to R4 are arranged separately from each other, so that the Roots pumps R1 to R4 are driven at different revolutions using a belt or a pulley (not shown).

In the case where the first conventional multistage vacuum pump unit is practically employed, the pumps P1, P2 are not supplied with loads uniformly depending on a flow rate of gas. It is thus necessary to set the optimum revolutions of the pumps P1, P2 in accordance with the flow rate of gas. However, the first conventional multistage vacuum pump unit is not provided with any detection means for detecting temperatures, pressures and current signals or any control circuit required to constitute a feedback system for setting the optimum revolutions. That is, the first conventional multistage vacuum pump unit is unable to set the optimum revolutions of the pumps in accordance with the flow rate of gas, so that the pumping speed is highly susceptible to a vacuum level.

The second conventional multistage vacuum pump unit requires setting a vacuum-side revolution to a higher value, using pumps of an equal capacity, and setting a rotor clearance less than 0.1 mm. Accordingly, the exhaust pipes E1 to E4 for the respective pumps are provided with expensive vacuum gauges, which causes a problem of cost enhancement.

SUMMARY OF THE INVENTION

It is a general object of the present invention to provide a multistage vacuum pump unit providing an inexpensive system capable of improving a backing pressure-side vacuum level, preventing a pumping speed from decreasing, and inhibiting a power from increasing.

It is another object of the present invention to provide a multistage vacuum pump unit based on a technical idea constituting using motors for driving a plurality of separate single-stage pumps connected in series with each other by exhaust pipes each connecting a suction port of one of adjacent single-stage pumps with an exhaust port of another of the adjacent single-stage pumps, detecting a driving current of the single-stage pump that is in contact with the atmospheric side, and controlling a revolution of the single-stage pump that is in contact with the atmospheric side.

It is still another object of the present invention to provide a multistage vacuum pump unit comprising a plurality of separate single-stage pumps connected in series with each other by exhaust pipes, the exhaust pipes each connecting a suction port of one of the adjacent single-stage pumps with an exhaust port of another of the adjacent single-stage pumps; motors for driving the separate single-stage pumps respectively; driving means for varying a revolution of one of the single-stage pumps that is at least in contact with an atmospheric side; and driving current detection means for detecting a driving current of the motor for driving the single-stage pump that is in contact with the atmospheric side.

It is a further object of the present invention to provide a multistage vacuum pump unit comprising a plurality of separate single-stage pumps connected in series with each other by exhaust pipes, the exhaust pipes each connecting a suction port of one of the adjacent single-stage pumps with an exhaust port of another of the adjacent single-stage pump; motors for driving the separate single-stage pumps respectively; driving means for varying a revolution of one of the single-stage pumps that is at least in contact with an atmospheric side; driving current detection means for detecting a driving current of the motor for driving the single-stage pump that is in contact with the atmospheric side; pressure detection means for detecting a pressure at a vacuum-side inlet; and control means for controlling revolutions of the motors of the single-stage pumps based on the pressure detected by the pressure detection means.

It is a still further object of the present invention to provide a multistage vacuum pump unit comprising a plurality of separate single-stage pumps connected in series with each other by exhaust pipes, the exhaust pipes each connecting a suction port of one of the adjacent single-stage pumps with an exhaust port of another of the adjacent single-stage pump; motors for driving the separate single-stage pumps respectively; driving means for varying a revolution of one of the single-stage pumps that is at least in contact with an atmospheric side; driving current detection means for detecting a driving current of the motor for driving the single-stage pump that is in contact with the atmospheric side; temperature detection means for detecting temperature at outlets of the respective single-stage pumps; and control means for controlling revolutions of the motors of the single-stage pumps based on the temperature detected by the temperature detection means.

It is a yet further object of the present invention to provide a multistage vacuum pump unit wherein the temperature detection means comprises temperature sensors located to at least more than one of the exhaust pipes connecting the suction ports and exhaust ports of the adjacent single-stage pumps. It is a yet further object of the present invention to provide a multistage vacuum pump unit wherein the pressure detection means comprises a vacuum detection means for detecting a vacuum level at the vacuum-side inlet; and the control means comprises a control circuit for controlling revolutions of the separate single-stage pumps based on the detected vacuum level.

It is another object of the present invention to provide a multistage vacuum pump unit wherein the temperature detection means comprises temperature sensors provided at outlets of the respective single-stage pumps; and further comprising: a control circuit for controlling revolutions of the motors in order to maintain a temperature in a gas passage at such a value that exhaust gas passing therethrough does not condense or solidify.

It is a further object of the present invention to provide a multistage vacuum pump unit comprising inter-coolers being located to at least more than one of the exhaust pipes connecting the suction ports and exhaust ports of the adjacent single-stage pumps, so that the inter-coolers cool the at least more than one of the exhaust pipes.

It is a still further object of the present invention to provide a multistage vacuum pump unit wherein the inter-coolers are provided with cooling water circulation means for circulating cooling water at a controlled flow rate in order to maintain a temperature in the gas passage at such a value that the exhaust gas passing therethrough does not condense or solidify.

According to the multistage vacuum pump unit of the present invention, the separate motors drive a plurality of single-stage pumps connected in series with each other by exhaust pipes each connecting a suction port of a single-stage pump with an exhaust port of another of the adjacent single-stage pumps subsequent to the single-stage pump, the driving current detection means detects a driving current of the motor for driving the single-stage pump that is in contact with the atmospheric side, and the driving means controls a revolution of the single-stage pump that is in contact with the atmospheric side based on the detected driving current. Therefore, the present invention provides an inexpensive system capable of improving a backing pressure-side vacuum level, preventing a pumping speed from decreasing, and inhibiting a power from increasing.

In the multistage vacuum pump unit of the present invention, the pressure detection means detects a pressure at a vacuum-side inlet. Accordingly, it is possible to perform control based on the pressure at the inlet detected by the pressure detection means.

In the multistage vacuum pump unit of the present invention, the control means sets revolutions of the single-stage pumps based on the pressure detected by the pressure detection means. Accordingly, the revolutions of the single-stage pumps are controlled in accordance with the detected pressure. It is thus possible to improve a vacuum level at the exhaust port of a vacuum-side one of the single-stage pumps connected in series with each other, and inhibit a power from increasing.

In the multistage vacuum pump unit of the present invention, the temperature detection means are allocated to at least more than one of the exhaust pipes each connecting a suction port of a single-stage pump with an exhaust port of another of the adjacent single-stage pumps subsequent to the single-stage pump. The temperature detection means detect temperatures at outlets of the respective single-stage pumps. Thereby, the revolutions of the motors for driving the single-stage pumps and the revolutions of the motors for driving the corresponding pumps are controlled, so that the exhaust pipes undergo adiabatic compression. As a result, there is generated a heat great enough to maintain the temperatures in the exhaust pipes to such values that the exhaust gas passing therethrough does not condense or solidify.

In the multistage vacuum pump unit of the present invention, the vacuum detection means constituting the pressure detection means detects a vacuum level at the vacuum-side inlet. The control circuit sets respective ratios between revolutions of the separate single-stage pumps. It is thus possible to improve the backing pressure-side vacuum level, prevent the pumping speed from decreasing, and inhibit the power from increasing.

In the multistage vacuum pump unit of the present invention, the temperature sensors measure respective temperatures at the outlets of the single-stage pumps, and the control circuit controls revolutions of the motors for driving the pumps. It is thus possible to maintain a temperature in a gas passage at such a value that the exhaust gas passing therethrough does not condense or solidify.

In the multistage vacuum pump unit of the present invention, the inter-coolers are provided to cool at least more than one of the exhaust pipes each connecting a suction port of a single-stage pump with an exhaust port of another of the adjacent single-stage pumps subsequent to the single-stage pump. It is thus possible to prevent movable portions of the single-stage pumps from interfering with each other due to thermal expansion caused by the heat of the exhaust gas.

In the multistage vacuum pump unit of the present invention according to claim 7, the cooling water circulation means adjusts respective flow rates of the cooling water circulating through the inter-coolers. It is thus possible to maintain a temperature in the gas passage to such a value that the exhaust gas passing therethrough does not condense or solidify.

DETAILED DESCRIPTION OF THE PREFERRED EMBODIMENTS

Embodiments of the present invention will be described with reference to the accompanying drawings.

(First Embodiment)

Figure 1:
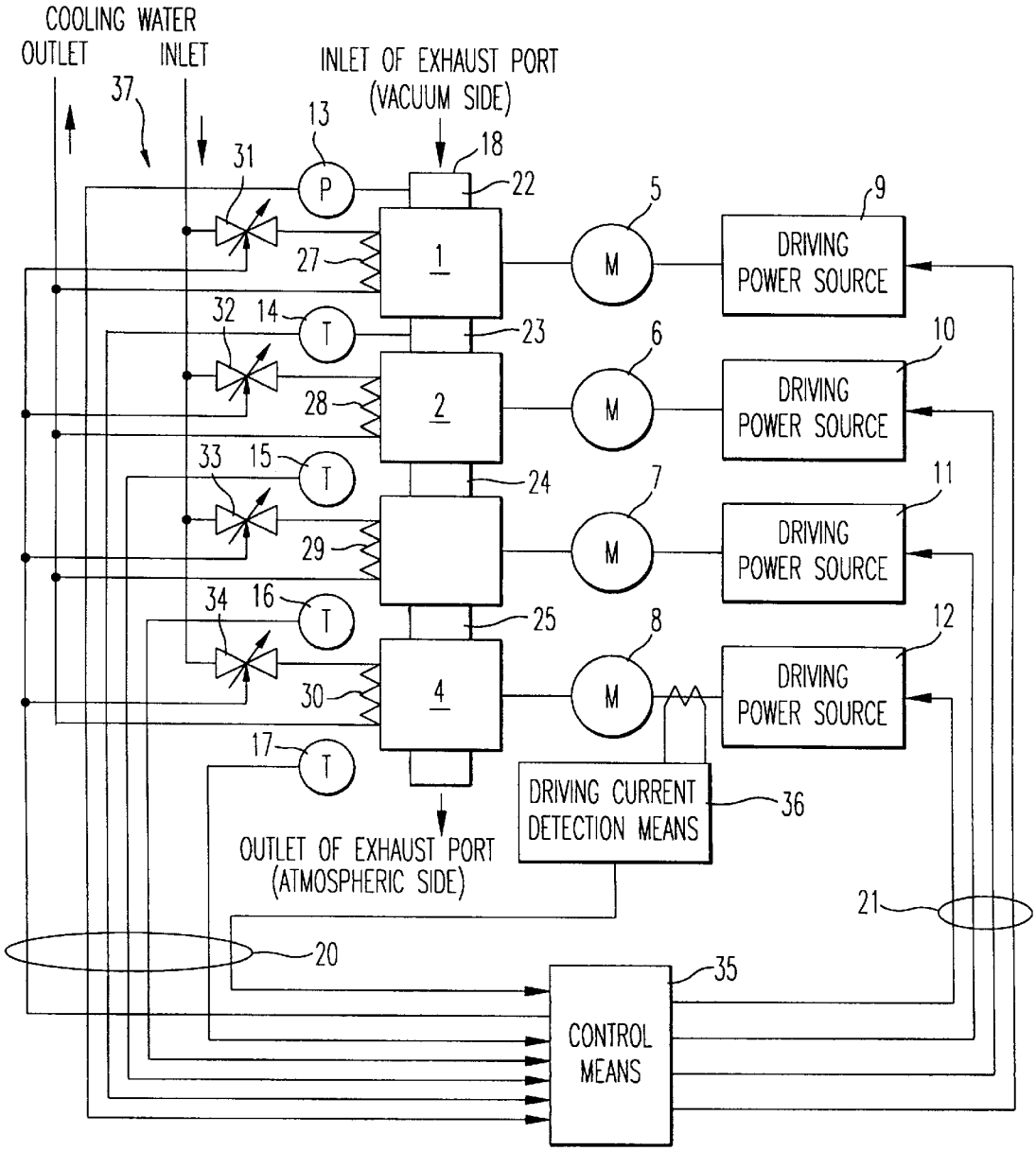
FIG. 1 is a block diagram showing the entire system of a multistage vacuum pump unit according to a first embodiment of the present invention.

Referring to FIG. 1, a multistage vacuum pump unit of the first embodiment includes a plurality of separate single-stage pumps 1 to 4 connected in series with each other by exhaust pipes 23 to 25 each connecting a suction port of one of adjacent single-stage pumps with an exhaust port of another of the adjacent single-stage pumps, separate motors 5 to 8 for driving the single-stage pumps 1 to 4 respectively, driving means 9 to 12 for varying revolutions of the single-stage pumps 1 to 4 respectively, and driving current detection means for detecting a driving current of the motor driving the single-stage pump that is in contact with the atmospheric side.

FIG. 1 shows the driving current detection means 36 for detecting a driving current supplied from the driving power source 12 of the motor 8, which drives the single-stage pump 4 that is in contact with the atmospheric side. The current value detected by the driving current detection means 36 is transmitted to control means 35.

FIG. 1 also shows pressure detection means 13 for detecting a pressure of a vacuum-side inlet 18. The pressure detection means 13 is constituted by vacuum detection means of Pirani type for detecting a vacuum level at the vacuum-side inlet. The control means 35 sets respective ratios between revolutions of the single-stage pumps 1 to 4, based on the vacuum level detected by the vacuum detection means 13.

The exhaust pipes 23 to 26 connected with the exhaust ports of the single-stage pumps 1 to 4 respectively are provided with temperature detection means 14 to 17 respectively. The temperature detection means 14 to 17 detect respective temperatures of the exhaust ports of the single-stage pumps 1 to 4. The temperature detection means 14 to 17 are connected with the control means 35. The control means 35 controls the respective revolutions of the single-stage pumps 1 to 4, thereby maintaining the temperature in a gas passage at such a value that the exhaust gas passing therethrough does not condense or solidify.

Referring to FIG. 1, inter-coolers 27 to 30 are respectively allocated to cases of the single-stage pumps 1 to 4 and the exhaust pipes 23 to 26 each connecting a suction port of one of adjacent single-stage pumps with an exhaust port of another of the adjacent single-stage pumps. The inter-coolers 27 to 30 are designed to cool the cases of the single-stage pumps 1 to 4 and the exhaust pipes 23 to 26 respectively.

Furthermore, FIG. 1 shows cooling water circulation means 37 that is connected with a cooling water reservoir (not shown) and provided with variable flow rate control valves 31 to 34 for controlling respective flow rates of cooling water. The cooling water circulates means 37 through the inter-coolers 27 to 30, thereby maintaining the temperature in the gas passage at such a value that the exhaust gas passing therethrough does not condense or solidify.

The control means 35 comprises mainly a CPU, a ROM which stores a control program, a memory which stored preliminarily data and a control circuit which controls revolution of the motors. The control means 35 is connected with the pressure sensor 13, the temperature sensors 14 to 17 and the flow rate control valves 31 to 34 via signal cables 20, and is connected with the driving power sources 9 to 11 via signal cables 21. The driving power sources 9 to 11 are thereby supplied with output signals via the signal cables 21 from the control means 35.

The inlet 18 of the vacuum-side single-stage pump 1 of the multistage vacuum pump unit of the first embodiment is connected with a vacuum chamber (not shown). By evacuating the vacuum chamber, the pressure established therein starts to decrease from the atmospheric pressure and eventually reaches a value between 1 Pa and 2 Pa.

At a higher vacuum level, the differential pressure between the suction port and the exhaust port of the single-stage pump 1 assumes several tens of Pa, which requires only a small power. Accordingly, a motor with a small capacity can be used to set the revolution of the single-stage pump 1 to a higher value. To the contrary, the differential pressure between the suction port and the exhaust port of the single-stage pump 4 assumes several ten kilos of Pa, which requires a great power. Accordingly, a motor with a large capacity is used to set the revolution of the single-stage pump 4 to a lower value.

At a lower vacuum level, the volumetric efficiency of the single-stage pump 1 is lower than that at a higher vacuum level, so that the pumping speed of the single-stage pump 1 decreases correspondingly. This especially holds true for the case where the vacuum level of the single-stage pump 1 constructed as a Roots pump is approximate to the atmospheric pressure. In this state, the differential pressure between the suction port and the exhaust port of the single-stage pump 1 is high, which requires a greater power. To the contrary, the differential pressure between the suction port and the exhaust port of the single-stage pump 4 is low, which requires a smaller power.

Figure 2:
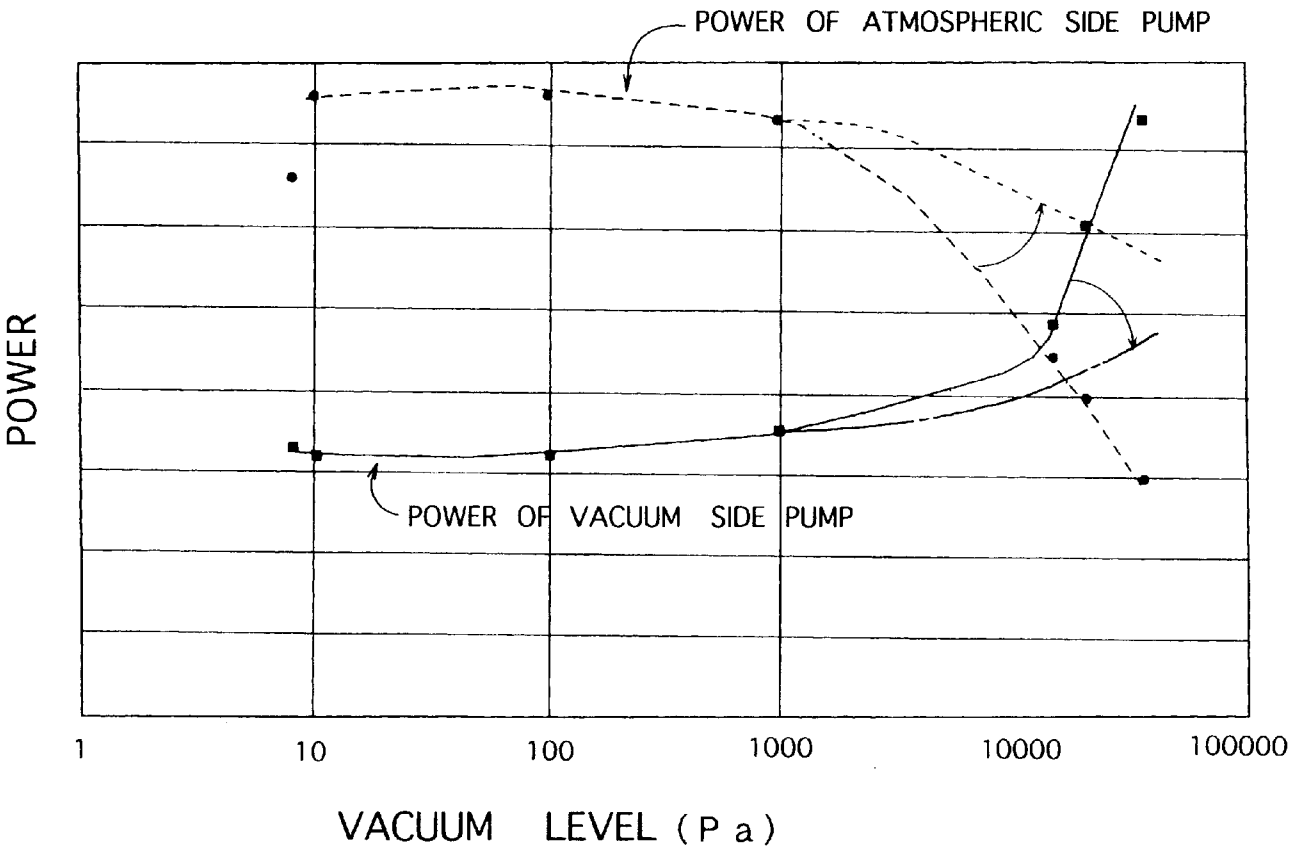
FIG. 2 is a graph showing the relationship between vacuum level and power of the first embodiment.
Figure 3:
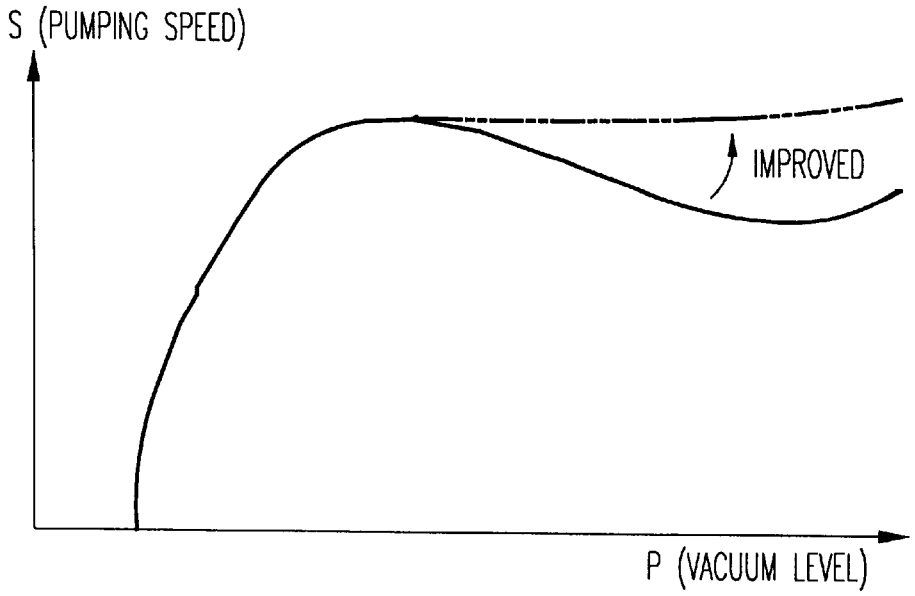
FIG. 3 is a graph showing the relationship between vacuum level and pumping speed of the first embodiment.

Accordingly, the backing pressure-side vacuum level of the single-stage pump 1 is improved by increasing the revolution of the single-stage pump 4, which makes it possible to prevent the pumping speed from decreasing as indicated by a chain line of FIG. 3 and inhibit the power of the single-stage pump 1 from increasing as indicated by a chain line of FIG. 2.

In particular, the conditions required in this case can be met by evacuating the vacuum chamber starting from the atmospheric pressure or supplying purging gas at a constant flow rate. Accordingly, the desired vacuum level is smoothly achieved, preferably by shifting the revolution of the single-stage pump 4 towards higher values at a lower vacuum level.

In order to perform this control, the pressure at the inlet 18 of the multistage vacuum pump unit is measured using the pressure gauge 13. In accordance with the pressure measured by the pressure gauge 13, the control means 35 sets the respective revolutions of the motors 5 to 8 which are realized in the form of a DC brushless motor.

As a much simpler alternative, it is also possible to estimate the vacuum level from the information on the revolution outputted to the driving power source 12 and the current value outputted from the driving current detection means 36, while keeping the revolutions of the motors 5 to 7 constant.

On the other hand, it is required to maintain the temperature in the gas passage of the multistage vacuum pump unit at such a value that the exhaust gas passing therethrough does not condense or solidify. In order to fulfill this requirement, the respective ratios between the revolutions of the single-stage pumps 1 to 4 of the multistage vacuum pump unit are set differently, so that the exhaust pipes 23 to 26, some being interposed between the single-stage pumps, are subjected to adiabatic compression. As a result, there is generated a heat great enough to maintain a predetermined temperature in each of the exhaust pipes 23 to 26.

In order to achieve this process, the temperatures at outlets of the single-stage pumps 1 to 4 are detected by the temperature detection means 14 to 17 and inputted to the control means 35. The control means 35 thereby controls the revolutions of the single-stage pumps 1 to 4 such that the predetermined temperature is maintained in each of the exhaust pipes 23 to 26.

In order to achieve a similar purpose, the cases of the single-stage pumps as well as the exhaust pipes 23 to 26 may be cooled. In this case, the variable flow rate control valves 31 to 34 controlled by the control means 35 adjust the overall cooling capacity by controlling the flow rate of cooling water. In the case where a certain single-stage pump is overheated and may contact a rotor, a corresponding flow rate control valve is fully opened to decrease the temperature in the gas passage. In the case where the temperature in the single-stage pump 1, 2, 3 or 4 is so low as to cause the exhaust gas passing therethrough to condense or solidify, a corresponding one of the flow rate control valves 31, 32, 33 or 34 is partially closed. Thereby, the temperature in the gas passage is increased and then maintained within a predetermined temperature range.

According to the multistage vacuum pump unit of the first embodiment, the separate single-stage pumps 1 to 4 are connected in series with each other by the exhaust pipes 23 to 25 each connecting a suction port of a single-stage pump with an exhaust port of another single-stage pump subsequent to the single-stage pump. The separate single-stage pumps 1 to 4 are driven by the motors 5 to 8 respectively. Also, the driving means 12 of the first embodiment controls the revolution of the single-stage pump 4 that has a large capacity and is at least in contact with the atmospheric side. It is thus possible to improve significantly the backing pressure-side vacuum level at the exhaust port of a vacuum-side one of the single-stage pumps connected in series.

Also, the driving current detection means 36 detects the driving current of the motor 8 for driving the single-stage pump 4 that is in contact with the atmospheric side. In accordance with the driving current detected by the driving current detection means 36, the revolution of the single-stage pump 4 that is in contact with the atmospheric side is controlled. Consequently, the multistage vacuum pump unit inhibits the power from increasing.

Furthermore, the control means 35 controls the revolutions of the motors 5 to 8 for driving the single-stage pumps 1 to 4 respectively, based on the pressure detected by the pressure detection means 13. That is, the revolutions of the single-stage pumps 1 to 4 are controlled in accordance with the pressure thus detected. As a result, the multistage vacuum pump unit of the first embodiment improves the backing pressure-side vacuum level of the aforementioned single-stage pump and inhibits the power from increasing.

Also, according to the multistage vacuum pump unit of the first embodiment, the temperature detection means 14 to 17 are respectively allocated to the exhaust pipes 23 to 26 each connecting a suction port of a single-stage pump with an exhaust port of another single-stage pump subsequent to the single-stage pump. The temperature detection means 14 to 17 detect the temperatures at the outlets of the single-stage pumps 1 to 4 respectively. The revolutions of the motors 5 to 8 for driving the single-stage pumps 1 to 4 respectively are controlled, so that the exhaust pipes 23 to 26 are subjected to adiabatic compression. As a result, there is generated a heat great enough to maintain the temperature in the exhaust pipes 23 to 26 at such a value that the exhaust gas passing therethrough does not condense or solidify.

Furthermore, the pressure detection means 13 detects the vacuum level at the vacuum-side inlet, and the control means 35 controls the revolutions of the separate single-stage pumps 1 to 4 based on the vacuum level detected by the pressure detection means 13. Accordingly, the multistage vacuum pump of the first embodiment improves the backing pressure-side vacuum levels of the single-stage pumps 1 to 4, prevents the pumping speed from decreasing, and inhibits the power from increasing.

Furthermore, according to the multistage vacuum pump unit of the first embodiment, the inter-coolers 27 to 30 are allocated to at least more than one of the exhaust pipes 23 to 26 connecting the respective suction ports and exhaust ports of the adjacent single-stage pump 1 to 4. The exhaust pipes 23 to 26 and the cases of the single-stage pumps 1 to 4 are cooled by the inter-coolers 27 to 30 respectively. It is thus possible to prevent movable portions of the single-stage pumps 1 to 4 from interfering with each other due to thermal expansion caused by the heat of the exhaust gas.

Also, the cooling water circulation means 37 controls the flow rate of the cooling water circulating through the inter-coolers 27 to 30 by means of the flow rate control valves 31 to 34 based on the commands from the control means 35. The multistage vacuum pump unit of the first embodiment thus maintains the temperature in the gas passage at such a value that the exhaust gas passing therethrough does not condense or solidify.

(Second Embodiment)

Figure 4:
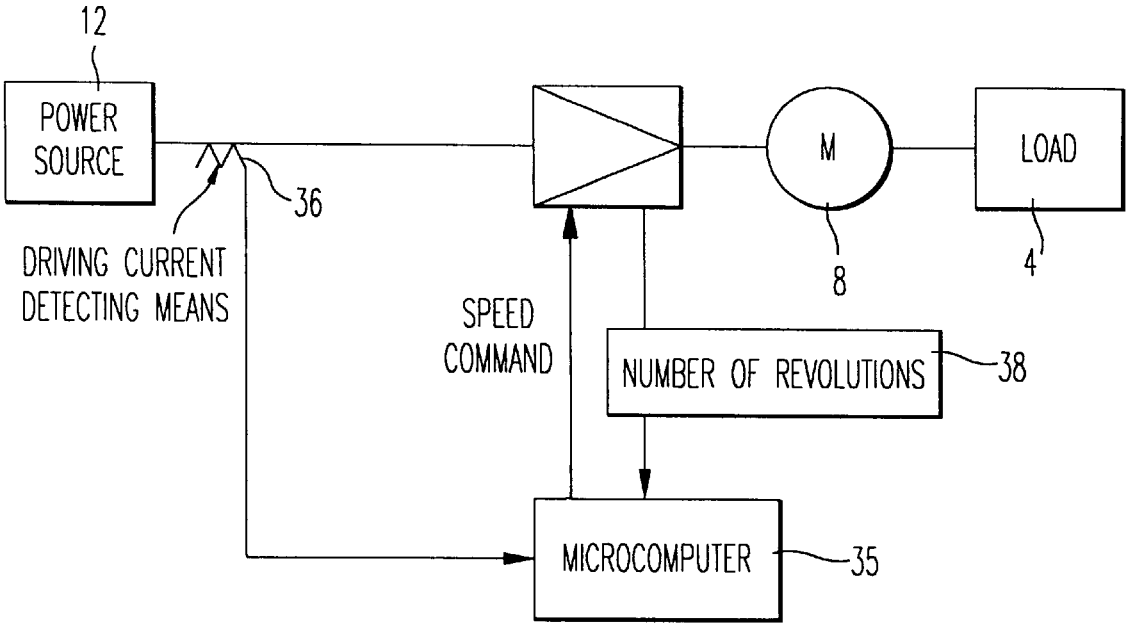
FIG. 4 is a block diagram showing a multistage vacuum pump unit according to a second embodiment of the present invention.
Figure 5:
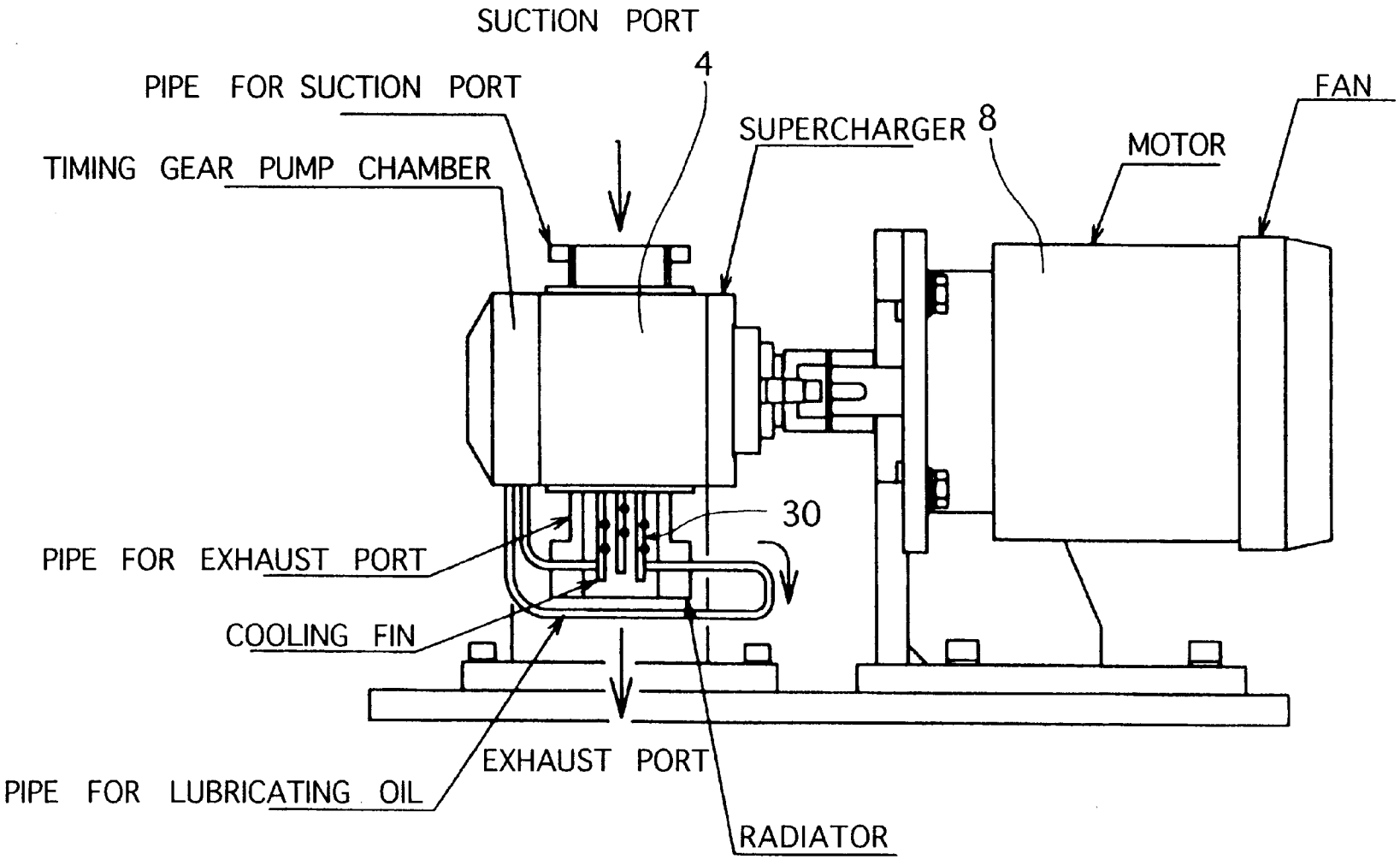
FIG. 5 is a side view of a Roots pump that is used as a single-stage pump of the second embodiment.

Referring to FIGS. 4, 5, the multistage vacuum pump unit of the second embodiment will now be described. The following description focuses on the fundamental difference between the first and second embodiments. The revolution of the single-stage pump 4 that is in contact with the atmospheric side is controlled based only on the driving current of the motor 8 for driving the single-stage pump 4, the driving current being detected by the driving current detection means 36. In this embodiment, there is no need to detect the vacuum level at the vacuum-side inlet.

In the second embodiment, the single-stage pump 4 illustrated in FIG. 4 as a load is composed of a Roots pump, which is rotatably driven by the motor 8 illustrated in FIG. 5.

Figure 6:
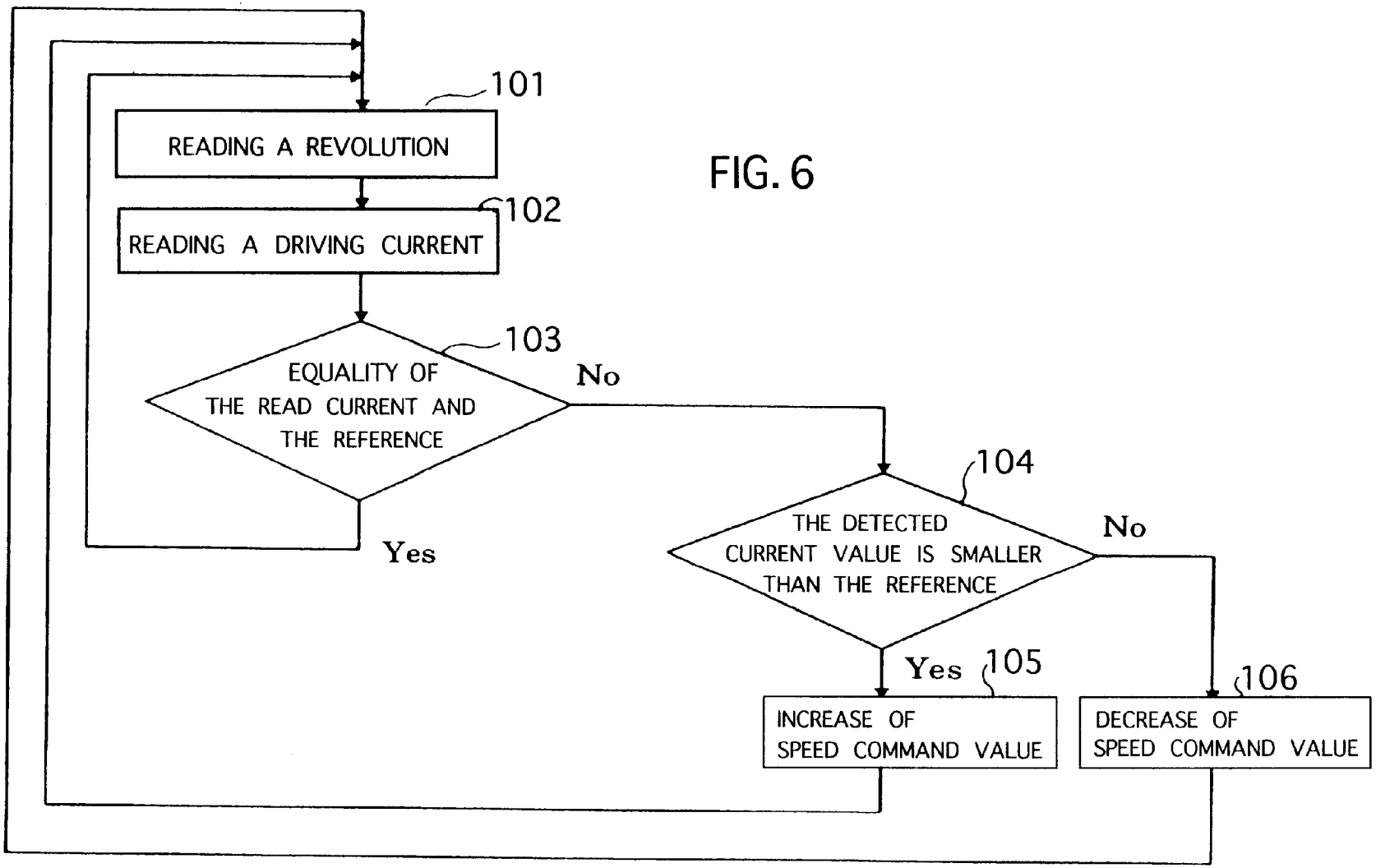
FIG. 6 is a flowchart showing the control flow of the second embodiment.

FIG. 6 shows a flowchart of a microcomputer serving as the control means 35. In step 101, revolution detection means 38 reads a revolution of the motor 8 for rotatably driving the Roots pump 4. In step 102, the driving current detection means 36 reads a value of the driving current of the motor 8.

In step 103, it is determined whether or not the detected current value is equal to a predetermined value. The predetermined value is decided based the map information which is the relation of a ideal revolution of the motor obtained from the size and characteristics of the motor and the driven current of the motor and is previously memorized within a memory in the control means. If it is determined that the detected current value is equal to the predetermined value, the operation returns to step 101. If it is determined that the detected current value is not equal to the predetermined value, the operation proceeds to step 104 where it is determined whether or not the detected current value is smaller than the predetermined value.

If it is determined that the detected current value is smaller than the predetermined value, the operation proceeds to step 105 where a speed command value is increased. If it is determined that the detected current value is greater than the predetermined value, the operation proceeds to step 106 where the speed command value is decreased.

According to the multistage vacuum pump of the second embodiment, the driving current detection means 36 detects the driving current of the motor 8 for driving the single-stage pump 4 that is in contact with the atmospheric side. The revolution of the single-stage pump 4 that has a large capacity and is in contact with the atmospheric side is controlled based on the driving current detected by the driving current detection means 36. It is thus possible to inhibit the power from increasing.

The multistage vacuum pump unit of the second embodiment controls the revolution (rotating speed) of the motor 8 based on the driving current of the motor 8, which eliminates the need to use an expensive vacuum detection device. It is thus possible to reduce the costs of the overall system and simplify the control logic.

(Third Embodiment)

Figure 7:
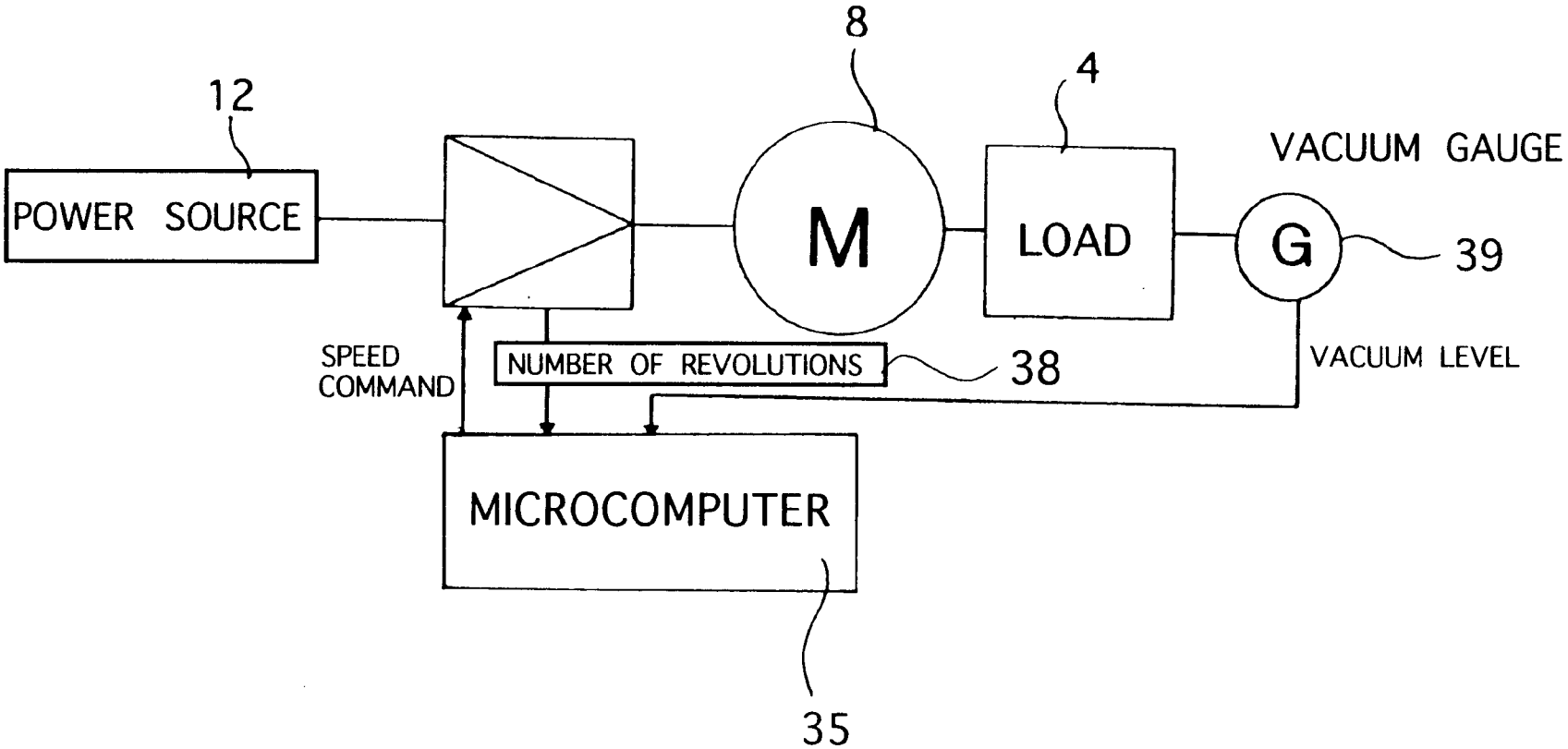
FIG. 7 is a block diagram showing a multistage vacuum pump unit according to a third embodiment of the present invention.
Figure 8:
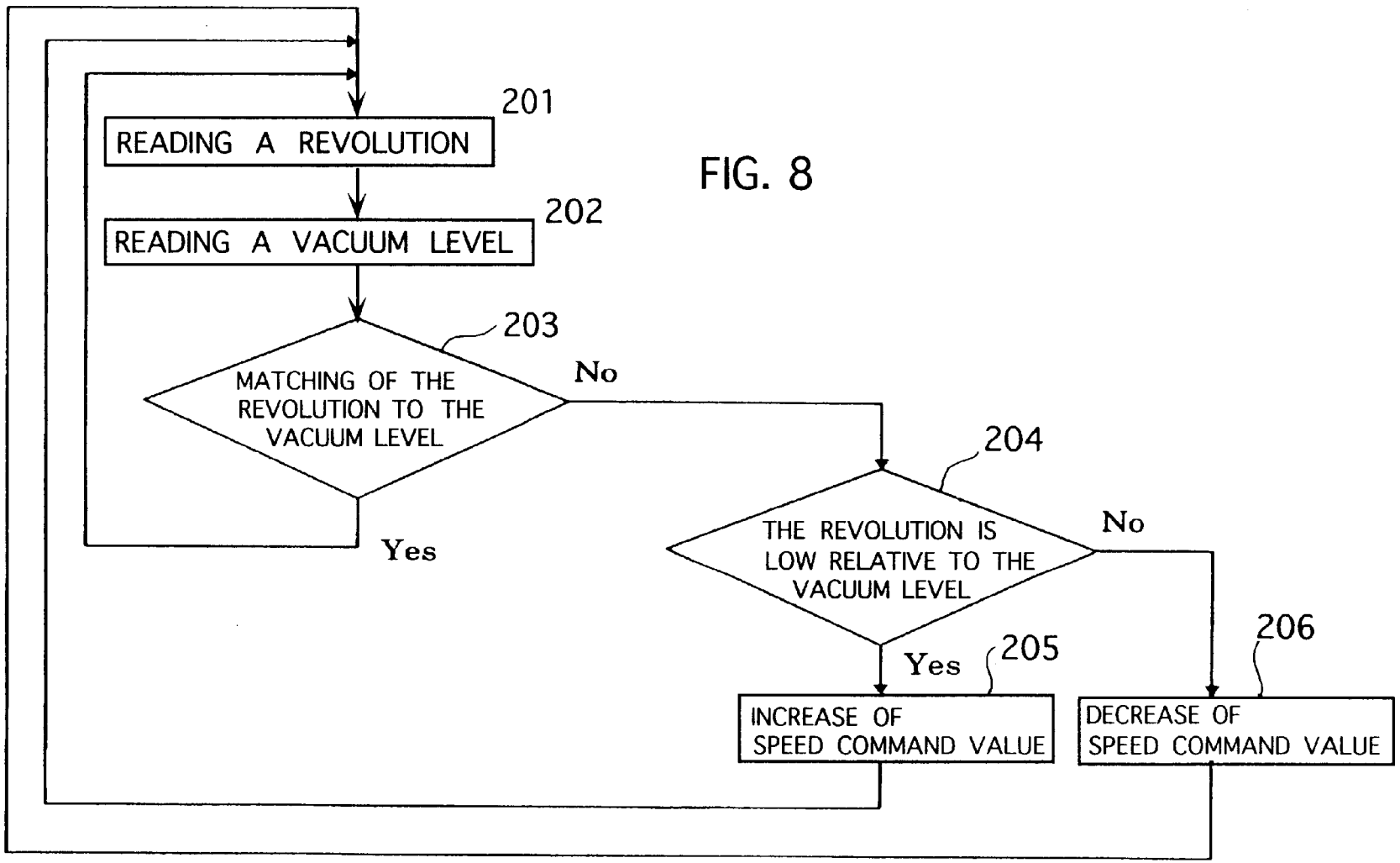
FIG. 8 is a flowchart showing the control flow of the third embodiment.
Figure 9:
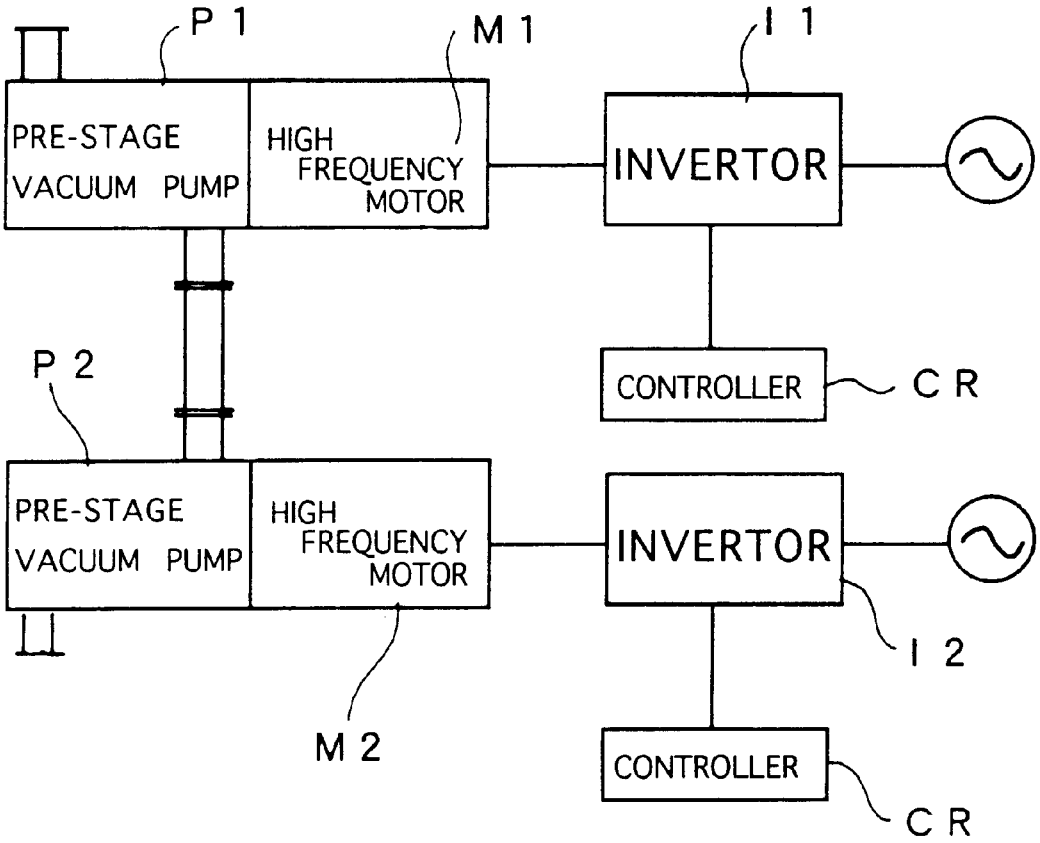
FIG. 9 is a block diagram showing a first conventional multistage vacuum pump unit.
Figure 10:
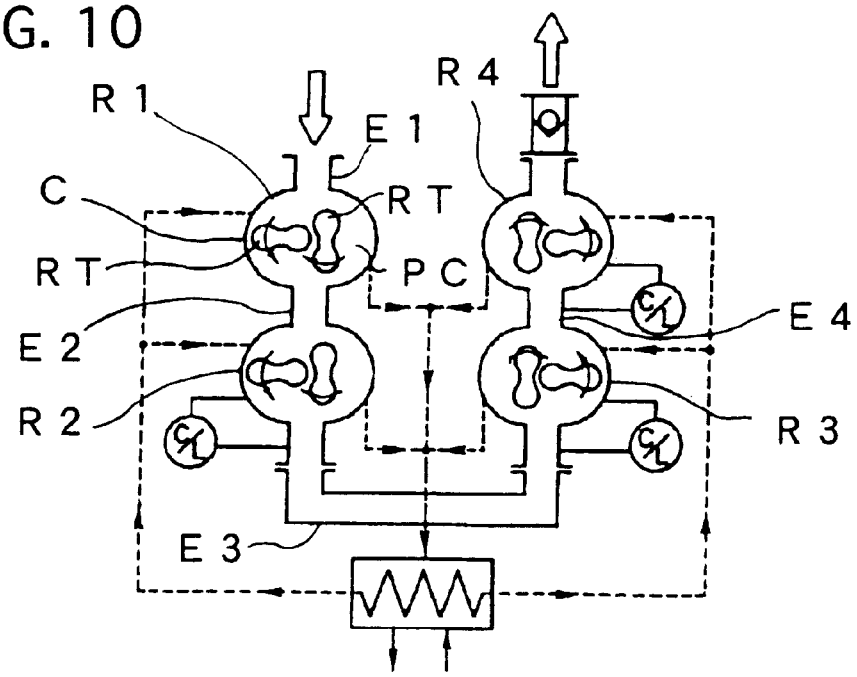
FIG. 10 is a block diagram showing a second conventional multistage vacuum pump unit.

Referring to FIGS. 7, 8, the multistage vacuum pump unit of the third embodiment will now be described. The following description focuses on the fundamental difference between the second and third embodiments. In this embodiment, the revolution of the single-stage pump 4 is controlled by directly detecting the vacuum level at the vacuum-side inlet.

In step 201 of a flowchart of FIG. 8, the microcomputer 35 serving as the control means reads a revolution of the motor 8 for rotatably driving the Roots pump 4. In step 202, a vacuum gauge 39 of Pirani type reads a vacuum level at the vacuum-side inlet.

In step 203, it is determined whether or not the revolution matches the detected vacuum level. When the difference between the detected revolution and the ideal revolution is within the pre-determined value, it is judged that the revolution matches the detected vacuum level. The ideal revolution is obtained from the size and characteristics of the motor and is previously memorized within a memory in the control means. If it is determined that the revolution matches the vacuum level, the operation returns to step 201. If it is determined that the revolution does not match the vacuum level, the operation proceeds to step 204. In step 204, it is determined whether or not the detected revolution is low relative to the vacuum level.

If it is determined that the revolution is low, the operation proceeds to step 205 where the speed command value is increased. If it is determined that the revolution is high, the operation proceeds to step 206 where the speed command value is decreased.

According to the multistage vacuum pump unit of the third embodiment, the vacuum gauge 39 detects the vacuum level at the vacuum-side inlet, and the control means 35 controls the revolutions of the single-stage pumps 1 to 4 respectively based on the detected vacuum level. It is thus possible to improve the backing pressure-side vacuum levels of the single-stage pumps 1 to 4, prevent the pumping speed from decreasing, and inhibit the power from increasing.

Also, as described above, the vacuum gauge 39 directly detects the vacuum level at the vacuum-side inlet, so that the revolution (rotating speed) of the motor is controlled in accordance with the relationship between the detected vacuum level and the revolution. Accordingly, the multistage vacuum pump unit of the third embodiment allows the revolution of the motor to be controlled precisely and appropriately.

The preferred embodiments of the present invention, as herein disclosed, are taken as some embodiments for explaining the present invention. It is to be understood that the present invention should not be restricted by these embodiments and any modifications and additions are possible so far as they are not beyond the technical idea or principle based on descriptions of the scope of the patent claims.

What is claimed is:

1. A multistage vacuum pump unit comprising:

a plurality of separate single-stage pumps having exhaust pipes, respectively connected in series with each other, said exhaust pipes each connecting a suction port of one of said single-stage pumps with an exhaust port of an adjacent single-stage pump;

motors equal in number to said single-stage pumps for driving said separate single-stage pumps, respectively;

driving current detection means for detecting a driving current of an atmospheric-side motor which drives the single-stage pump whose exhaust pipe is in contact with the atmospheric side and varies a rotational speed of the single-stage pump whose exhaust pipe is in contact with the atmospheric side; and control means for controlling a rotational of said atmospheric-side motor based on the driving current detected by said driving current detection means.

2. A multistage vacuum pump unit comprising:

a plurality of separate single-stage pumps having exhaust pipes, respectively connected in series with each other, said exhaust pipes each connecting a suction port of one of said single-stage pumps with an exhaust port of an adjacent single-stage pump;

motors equal in number to said single-stage pumps for driving said separate single-stage pumps, respectively;

driving current detection means for detecting a driving current of an atmospheric-side motor for driving said single-stage pump whose exhaust pipe is in contact with the atmospheric side;

temperature detection means for detecting a temperature at outlets of said respective single-stage pumps; and control means for controlling a rotational speed of said motors of said single-stage pumps based on the driving current of said driving current detection means and the temperature detected by said temperature detection means, and for varying a rotational speed of the motor one of said single-stage pumps that is in contact with an atmospheric side.

3. The multistage vacuum pump unit according to claim 2, wherein said temperature detection means comprises temperature sensors provided at outlets of said respective single-stage pumps; and further comprising:

a control circuit for controlling rotational speed of said motors in order to maintain a temperature in a gas passage at such a value that exhaust gas passing therethrough is maintained at gas condition.

4. A multistage vacuum pump unit comprising:

a plurality of separate single-stage pumps having exhaust pipes, respectively connected in series with each other, said exhaust pipes each connecting a suction port of one of said single-stage pumps with an exhaust port of an adjacent single-stage pump;

motors equal in number to said single-stage pumps for driving said separate single-stage pumps respectively;

pressure detection means for detecting a pressure at a vacuum-side inlet; and control means for controlling a rotational speed of an atmospheric-side motor which drives one of the single-stage pumps whose exhaust pipe is in contact with the atmospheric side, based on the pressure detected by said pressure detection means, and for varying a the rotational speed of the motor of the one of said single-stage pumps driven by said atmospheric side motor.

5. The multistage vacuum pump unit according to claim 2, wherein said temperature detection means comprises temperature sensors located to at least more than one of said exhaust pipes connecting said suction ports and exhaust ports of said adjacent single-stage pumps.

6. The multistage vacuum pump unit according to claim 4, further comprising:

inter-coolers being located to at least more than one of said exhaust pipes connecting said suction ports and exhaust ports of said adjacent single-stage pumps, so that said inter-coolers cool said at least more than one of said exhaust pipes.

7. The multistage vacuum pump unit according to claim 6, wherein said inter-coolers are provided with cooling water circulation means for circulating cooling water at a controlled flow rate in order to maintain a temperature in the gas passage at such a value that the exhaust gas passing therethrough is maintained at gas condition.

8. The multistage vacuum pump unit according to claim 1, further comprising:

temperature detection means for detecting temperature at outlets of said respective single-stage pumps.

9. The multistage vacuum pump unit according to claim 8, further comprising:

inter-coolers being located to said respective exhaust pipes of said respective single-stage pumps so as to cool said respective exhaust pipes and a cases of said respective single-stage pumps and a casing of each pump of said respective single-stage pumps.

10. The multistage vacuum pump unit according to claim 9, further comprising cooling water circulation means, having respective variable flow rate control valves provided between a cooling water reservoir and said respective inter-coolers, for circulating cooling water at a controlled flow rate due to said respective variable flow rate control valves.

11. A multistage vacuum pump unit comprising:

a plurality of separate single-stage pumps having exhaust pipes, respectively connected in series with each other, said exhaust pipes each connecting a suction port of one of said single-stage pumps with an exhaust port of an adjacent single-stage pump;

motors equal in number to said single-stage pumps for driving said separate single-stage pumps, respectively;

driving current detection means for detecting a driving current of the motor for driving one of said single-stage pumps whose exhaust pipe is in contact with the atmospheric side, and for varying a rotational speed of said one of said single-stage pumps whose exhaust pipe is in contact with an atmospheric side; and control means for controlling rotational speeds of said motors of said single-stage pumps based on the driving current detected by said driving current detection means.

12. The multistage vacuum pump unit according to claim 11, wherein said driving means comprises means for varying a rotational speed of the motor of said one of said single-stage pumps whose exhaust pipe is in contact with the atmospheric side.

13. The multistage vacuum pump unit according to claim 12, further comprising:

rotational speed detection means for detecting the rotational speed of said single stage pumps.

14. The multistage vacuum pump unit according to claim 13, wherein said single-stage pumps each comprises a Roots pump.

15. The multistage vacuum pump unit according to claim 4, wherein said vacuum detection means comprises a vacuum gauge of Pirani type.

16. The multistage vacuum pump according to claim 4, wherein said pressure detection means comprises a vacuum detection means for detecting a vacuum level at the vacuum-side inlet; and said control means comprises a control circuit for controlling the rotational speeds of the separate single-stage pumps based on the detected vacuum level.

17. A multistage vacuum pump unit according to claim 16, further comprising driving current detection means for detecting a driving current of the atmospheric-side motor and for varying a rotational speed of the pump driven by said atmospheric-side motor pump, and wherein said control means controls a rotational speed of said atmospheric-side motor based on the pressure detected by said pressure detection means and the driving current of said atmospheric-side motor detected by said driving current detection means.

18. A multistage vacuum pump unit comprising:

a plurality of separate single-stage pumps having exhaust pipes, respectively connected in series with each other, said exhaust pipes each connecting a suction port of one of said single-stage pumps with an exhaust port of an adjacent single-stage pump;

motors equal in number to said single-stage pumps for driving said separate single-stage pumps, respectively;

driving current detection means for detecting a driving current of an atmospheric-side motor which drives the single-stage pump whose exhaust pipe is in contact with the atmospheric side and varies a rotational speed of the same pump; and control means for controlling a rotational speed of the motor of the single-stage pump whose exhaust pipe is in contact with the atmospheric side based on the driving current detected by said driving current detection means.

* * * * *